US008380496B2

(12) United States Patent
Rämö et al.

(10) Patent No.: US 8,380,496 B2
(45) Date of Patent: Feb. 19, 2013

(54) METHOD AND SYSTEM FOR PITCH CONTOUR QUANTIZATION IN AUDIO CODING

(75) Inventors: Anssi Rämö, Tampere (FI); Jani Nurminen, Tampere (FI); Sakari Himanen, Tampere (FI); Ari Heikkinen, Tampere (FI)

(73) Assignee: Nokia Corporation, Espoo (FI)

( * ) Notice: Subject to any disclaimer, the term of this patent is extended or adjusted under 35 U.S.C. 154(b) by 614 days.

(21) Appl. No.: 12/150,307

(22) Filed: Apr. 25, 2008

(65) Prior Publication Data

US 2008/0275695 A1 Nov. 6, 2008

Related U.S. Application Data

(63) Continuation of application No. 10/692,291, filed on Oct. 23, 2003, now abandoned.

(51) Int. Cl.
*G10L 11/04* (2006.01)
*G10L 19/00* (2006.01)

(52) U.S. Cl. ..... 704/207; 704/500; 704/501; 704/219; 704/223

(58) Field of Classification Search ..... 704/206–207, 704/220, 222, 219, 223, 500, 501
See application file for complete search history.

(56) References Cited

U.S. PATENT DOCUMENTS 4,701,955 A 10/1987 Taguchi
5,042,069 A 8/1991 Chhatwal et al.
5,592,585 A 1/1997 Van Coile et al. ..... 395/2.15
5,673,361 A 9/1997 Ireton
5,704,000 A 12/1997 Swaminathan et al. ..... 337/595
5,787,387 A 7/1998 Aguilar ..... 704/208
5,870,405 A 2/1999 Hardwick et al.
5,886,276 A 3/1999 Levine et al.
5,911,128 A 6/1999 DeJaco
5,991,725 A 11/1999 Asghar et al.
6,014,622 A 1/2000 Su et al.
6,078,880 A 6/2000 Zinser, Jr. et al.
6,094,629 A 7/2000 Grabb et al.
6,108,626 A 8/2000 Cellario et al.
6,119,082 A 9/2000 Zinser, Jr. et al.
6,163,766 A 12/2000 Kleider et al.

(Continued)

FOREIGN PATENT DOCUMENTS

WO WO 00/11653 3/2000

OTHER PUBLICATIONS

Lee et al. "A Very Low Bit Rate Speech Coder Based on a Recognition/Synthesis Paradigm," 2001. IEEE Transactions on Speech and Audio Processing 9 (5), July, 482-491.*

(Continued)

*Primary Examiner* — Jialong He
(74) *Attorney, Agent, or Firm* — Alston & Bird LLP

(57) ABSTRACT

A method and device for improving coding efficiency in audio coding. From the pitch values of a pitch contour of an audio signal, a plurality of simplified pitch contour segments are generated to approximate the pitch contour, based on one or more pre-selected criteria. The contour segments can be linear or non-linear with each contour segment represented by a first end point and a second end point. If the contour segments are linear, then only the information regarding the end points, instead of the pitch values, are provided to a decoder for reconstructing the audio signal. The contour segment can have a fixed maximum length or a variable length, but the deviation between a contour segment and the pitch values in that segment is limited by a maximum value.

23 Claims, 5 Drawing Sheets

U.S. PATENT DOCUMENTS

| | | | | |
|---|---|---|---|---|
| 6,169,970 | B1 | 1/2001 | Kleijn | 704/219 |
| 6,246,672 | B1 | 6/2001 | Lumelsky | 370/310 |
| 6,295,546 | B1 | 9/2001 | Adiletta | |
| 6,385,434 | B1 | 5/2002 | Chuprun et al. | |
| 6,434,519 | B1 | 8/2002 | Manjunath et al. | |
| 6,449,590 | B1 * | 9/2002 | Gao | 704/219 |
| 6,453,287 | B1 | 9/2002 | Unno et al. | |
| 6,484,138 | B2 | 11/2002 | DeJaco | |
| 6,496,798 | B1 | 12/2002 | Huang et al. | |
| 6,581,032 | B1 | 6/2003 | Gao et al. | |
| 6,691,082 | B1 | 2/2004 | Aguilar et al. | |
| 6,735,567 | B2 | 5/2004 | Gao et al. | |
| 6,810,377 | B1 | 10/2004 | Ho et al. | |
| 6,850,884 | B2 | 2/2005 | Gao et al. | |
| 6,934,677 | B2 | 8/2005 | Chen et al. | |
| 6,963,833 | B1 | 11/2005 | Singhal | |
| 7,039,584 | B2 * | 5/2006 | Gournay et al. | 704/221 |
| 7,120,578 | B2 | 10/2006 | Thyssen et al. | |
| 7,143,030 | B2 | 11/2006 | Chen et al. | |
| 7,191,136 | B2 | 3/2007 | Sinha et al. | |
| 7,222,070 | B1 | 5/2007 | Stachurski et al. | |
| 7,280,969 | B2 * | 10/2007 | Eide et al. | 704/268 |
| 2001/0031003 | A1 | 10/2001 | Sawhney et al. | |
| 2001/0049598 | A1 | 12/2001 | Das | |
| 2002/0007269 | A1 | 1/2002 | Gao | |
| 2002/0065655 | A1 | 5/2002 | Gournay et al. | 704/241 |
| 2003/0002446 | A1 | 1/2003 | Komaili et al. | 370/252 |
| 2003/0074192 | A1 | 4/2003 | Choi et al. | |
| 2003/0105624 | A1 | 6/2003 | Yokoyama | 704/201 |
| 2003/0115051 | A1 | 6/2003 | Chen et al. | |
| 2003/0200092 | A1 | 10/2003 | Gao et al. | |
| 2004/0049384 | A1 | 3/2004 | Subramaniam et al. | |
| 2005/0071153 | A1 | 3/2005 | Tammi et al. | 704/219 |

OTHER PUBLICATIONS

Sonmez et al, "Modeling dynamic prosodic variation for speaker verification", in R. H. Mannelland J. Robert-Ribes, editors, Proc. ICSLP, vol. 7, Australian Speech Science and Technology As-sociation, Dec. 1998, pp. 3189-3192.*

Lee et al, "TTS Based Very Low Bit Rate Speech Coder", Proc. ICASSP-99, 1999, pp. 1-4.*

Sonmez et al. "Modeling Dynamic Prosodic Variation for Speaker Verification", 5th International Conference on Spoken Language Processing Sydney, Australia, Nov. 30-Dec. 4, 1998.*

"Aneto: a tool for prosody analysis of speech", Miquel Febrer, et al, Universitat Politecnica de Catalunya C/Jordi Girona 1-3 08034 Barcelona, Spain, http://gps-tsc.upc.es/veu.

"Segment Vocoder Based on Reconstruction with Natural Segments", Philippe Jeanrenaud, et al, S9.9, IEEE, p. 605-608, BBN Systems and Technologies, 10 Moulton Street, Cambridge, MA 02138, CH2977-7/91/0000-0605, 1991.

"A Very Low Bit Rate Speech Coder Based on a Recognition/Synthesis Paradigm", Ki-Seung Lee, et al, IEEE Transactions on Speech and Audio Processing, vol. 9, No. 5, Jul. 2001, 1063-6676/01.

"R/D Optimal Linear Prediction", Paolo Prandoni, et al, IEEE Transactions on Speech and Audio Processing., vol. 8, No. 6, Nov. 2000, 1063-6676/00.

"Speech Analysis/Synthesis Based on a Sinusoidal Representation", Robert J. McAulay, et al, IEEE Transactions on Acoustics, Speech, and Signal Processing, vol. ASSP-34, No. 4, Aug. 1986, 0096-3518/86/0800-0744.

"Code-Excited Linear Prediction (CELP): High-Quality Speech at Very Low Bit Rates", Manfred R. Schroeder, et al, IEEE, CH2118-8/85/0000-0937, 1985.

"Robust Speech Mode Based LSF Vector Quantization for Low Bit Rate Coders", S. Nandkumar, et al, Hughes Network Systems, Germantown, Maryland 20876, IEEE 0-7803-4428-6/98 1998.

Office Action from Chinese Patent Application No. 200480034310.X, dated May 2, 2012.

Stefanovic, M. et al.; "Source-Dependent Variable Rate Speech Coding Below 3 KBPS"; 6th European Conference on Speech Communication and Technology; Eurospeech '99 Budapest, Hungary, Sep. 5-9, 1999; Bonn: ECSA, DE, Sep. 5, 1999; pp. 1487-1490; XP001075962.

Paksoy, E., et al.; "Variable Rate Speech Coding for Multiple Access Wireless Networks"; Electrotechnical Conference, 1994; Proceedings 7$^{th}$ Apr. 12, 1994, pp. 47-50; XP010130866.

Tang, K W et al.; "Fixed bit-rate PWI speed coding with variable frame length"; Global Telecommunications Conference, 1995; Conference Record; Communication Theory Mini-Conference, Globecom '95, IEEE Singapore 13-17 No. 1995, New York, NY, USA, IEEE, US, vol. 3, Nov. 13, 1995, pp.1600-1603; XP010164674.

* cited by examiner

METHOD AND SYSTEM FOR PITCH CONTOUR QUANTIZATION IN AUDIO CODING

CROSS REFERENCES TO RELATED APPLICATIONS

This is a continuation application of and claims benefit to a U.S. patent application Ser. No. 10/692,291, filed Oct. 23, 2003 now abandoned.

FIELD OF THE INVENTION

The present invention relates generally to a speech coder and, more specifically, to a speech coder that allows a sufficiently long encoding delay.

BACKGROUND OF THE INVENTION

It will become required in the United States to take visually impaired persons into consideration when designing mobile phones. Manufactures of mobile phones must offer phones with a user interface suitable for a visually impaired user. In practice, this means that the menus are "spoken aloud" in addition to being displayed on the screen. It is obviously beneficial to store these audible messages in as little memory as possible. Typically, text-to-speech (TTS) algorithms have been considered for this application. However, to achieve reasonable quality TTS output, enormous databases are needed and, therefore, TTS is not a convenient solution for mobile terminals. With low memory usage, the quality provided by current TTS algorithms is not acceptable.

Besides TTS, a speech coder can be utilized to compress pre-recorded messages. This compressed information is saved and decoded in the mobile terminal to produce the output speech. For minimum memory consumption, very low bit rate coders would be desired. To generate the input speech signal to the coding system, either human speakers or high-quality (and high-complexity) TTS algorithms can be used.

In a typical speech coder, the input speech signal is processed in fixed-length segments called frames. In current speech coders the frame length is usually 10-30 ms, and a lookahead segment of around 5-15 ms from the subsequent frame may also be available. The frame may further be divided into a number of subframes. For every frame, the encoder determines a parametric representation of the input signal. The parameters are quantized, and transmitted through a communication channel or stored in a storage medium. At the receiving end, the decoder constructs a synthesized signal based on the received parameters, as shown in FIG. 1.

While one underlying goal of speech coding is to achieve the best possible quality at a given coding rate, other performance aspects also have to be considered in developing a speech coder to a certain application. In addition to speech quality and bit rate, the main attributes described in more detail below include coder delay (defined mainly by the frame size plus a possible lookahead), complexity and memory requirements of the coder, sensitivity to channel errors, robustness to acoustic background noise, and the bandwidth of the coded speech. Also, a speech coder should be able to efficiently reproduce input signals with different energy levels and frequency characteristics.

Quantization of the pitch contour is a task that is required in almost all practical speech coders. The pitch parameter is related to the fundamental frequency of speech: during voiced speech, the pitch corresponds to the fundamental frequency and can be perceived as the pitch of speech. During purely unvoiced speech, there is no fundamental frequency in a physical sense and the concept of pitch is vague. In most speech coders, however, the "pitch information" is also needed during unvoiced speech. For example, in coders based on the well-known code excited linear prediction (CELP) approach, the long term prediction lag (roughly corresponding to pitch) is also transmitted during unvoiced portions of speech.

In a typical speech coder, the pitch parameter is estimated from the signal at regular intervals. The pitch estimators used in speech coders can roughly be divided into the following categories: (i) pitch estimators utilizing the time domain properties of speech, (ii) pitch estimators utilizing the frequency domain properties of speech, (iii) pitch estimators utilizing both the time and frequency domain properties of speech.

The most common prior-art solution to the quantization of the pitch contour (pitch values estimated at regular intervals) is to use scalar quantization. Typically, a single quantizer is used for all pitch values and the transmission rate is held fixed. Alternative solutions have also been proposed. For example, every second pitch value can be quantized using a scalar quantizer and the values between these can be coded with a differential quantizer. In some of the existing encoders, the quantizer contained two modes, a memoryless mode and a predictive mode. These techniques offer some advantages, when compared to the basic approach, but the redundancies are only partially exploited.

The main drawback of the prior art is that the conventional quantization techniques with fixed update rates are inherently inefficient because there is a lot of redundancy in the pitch values transmitted. The fixed update rate used in the quantization of the pitch parameter is usually rather high (about 50 to 100 Hz) in order to be able to handle cases in which the pitch changes rapidly. However, rapid variations in the pitch contour are relatively rare. Consequently, a much lower update rate could be used most of the time.

SUMMARY OF THE INVENTION

The present invention exploits the fact that a typical pitch contour evolves fairly smoothly but contains occasional rapid changes. Thus, it is possible to construct a piece-wise pitch contour that closely follows the shape of the original contour but contain less information to be coded. Instead of coding every pitch of the pitch contour, only the points defining the piece-wise pitch contour where the derivative changes are quantized. During unvoiced speech, a constant default pitch value can be used both at the encoder and at the decoder. The segments on the piece-wise pitch contour can be linear or non-linear.

Thus, according to the first aspect of the present invention, there is provided a method for improving coding efficiency in audio coding, wherein an audio signal is encoded for providing parameters indicative of the audio signal, the parameters including pitch contour data containing a plurality of pitch values representative of an audio segment in time. The method comprises the steps of:

creating, based on the pitch contour data, a plurality of simplified pitch contour segment candidates, each candidate corresponding to a sub-segment of the audio signal;

measuring deviation between each of the simplified pitch contour segment candidates and said pitch values in the corresponding sub-segment;

selecting one of said candidates based on the measured deviations and one or more pre-selected criteria; and coding the pitch contour data in the sub-segment of the audio signal corresponding to the selected candidate with characteristics of the selected candidate.

According to one embodiment of the present invention, the pitch contour data in the audio segment in time is approximated by a plurality of selected candidates, corresponding to a plurality of consecutive sub-segments in said audio segment, each of said plurality of selected candidates defined by a first end point and a second end point, and wherein said coding comprises the step of providing information indicative of the end points so as to allow the decoder to reconstruct the audio signal in the audio segment based on the information instead of the pitch contour data. The number of pitch values in some of the consecutive sub-segment is equal to or greater than 3.

According to one embodiment of the present invention, the creating step is limited by a pre-selected condition such that the deviation between each of the simplified pitch contour segment candidates and each of said pitch values in the corresponding sub-segment is smaller than or equal to a predetermined maximum value.

According to one embodiment of the present invention, the created segment candidates have various lengths, and said selecting is based on the lengths of the segment candidates, and the pre-selected criteria include that the selected candidate has the maximum length among the segment candidates.

According to one embodiment of the present invention, the selecting step is based on the lengths of the segment candidates, and the pre-selected criteria include that the measured deviation is minimum among a group of the candidates having the same length.

According to one embodiment of the present invention, each of the simplified pitch contour segment candidates has a starting point and an end point, and said creating is carried out by adjusting the end point of the segment candidates.

The audio signal comprises a speech signal.

According to the second aspect of the present invention, there is provided a coding device encoding an audio signal, comprising pitch contour data containing a plurality of pitch values representative of an audio segment in time. The coding device comprises:

an input end for receiving the pitch contour data;

a data processing module, responsive to the pitch contour data, for creating a plurality of simplified pitch contour segment candidates, each candidate corresponding to a sub-segment of the audio signal, wherein the processing module comprises:

an algorithm for measuring deviation between each of the simplified pitch contour segment candidates and said pitch values in the corresponding sub-segment; and an algorithm for selecting one of said candidates based on the measured deviations and pre-selected criteria; and a quantization module, responsive to the selected candidate, for coding the pitch contour data in the sub-segment of the audio signal corresponding to the selected candidate with characteristics of the selected candidate.

According to one embodiment of the present invention, the quantization module provides audio data indicative of the coded pitch contour data in the sub-segment. The coding device further comprises a storage device, operatively connected to the quantization module to receive the audio data, for storing the audio data in a storage medium.

According to another embodiment of the present invention, the coding device further comprises an output end, operatively connected to a storage medium, for providing the coded pitch contour data to the storage medium for storage.

According to yet another embodiment of the present invention, the coding device further comprises an output end for transmitting the coded pitch contour data to the decoder so as to allow the decoder to reconstruct the audio signal also based on the coded pitch contour data.

According to the third aspect of the present invention, there is provided a computer software product embodied in an electronically readable medium for use in conjunction with an audio coding device, the audio coding device providing parameters indicative of the audio signal, the parameters including pitch contour data containing a plurality of pitch values representative of an audio segment in time. The software product comprises:

a code for creating a plurality of simplified pitch contour segment candidates based on the pitch contour data, each candidate corresponding to a sub-segment of the audio signal;

a code for measuring deviation between each of the simplified pitch contour segment candidates and said pitch values in the corresponding sub-segment; and a code for selecting one of said candidates based on the measured deviations and pre-selected criteria, so as to allow a quantization module to code the pitch contour data in the sub-segment of the audio signal corresponding to the selected candidate with characteristics of the selected candidate.

According to the fourth aspect of the present invention, there is provided a decoder for reconstructing an audio signal, wherein the audio signal is encoded for providing parameters indicative of the audio signal, the parameters including pitch contour data containing a plurality of pitch values representative of an audio segment in time, and wherein the pitch contour data in the audio segment in time is approximated by a plurality of consecutive sub-segments in the audio segment, each of said sub-segments defined by a first end point and a second end point. The decoder comprises:

an input for receiving audio data indicative of the end points defining the sub-segments; and reconstructing the audio segment based on the received audio data.

According to one embodiment of the present invention, the audio data is recorded on an electronic media, and the input of the decoder is operatively connected to electronic media for receiving the audio data.

According to another embodiment of the present invention, the audio data is transmitted through a communication channel, and the input of the decoder is operatively connected to the communication channel for receiving the audio data.

According to the fifth aspect of the present invention, there is provided an electronic device, comprising:

a decoder for reconstructing an audio signal, wherein the audio signal is encoded for providing parameters indicative of the audio signal, the parameters including pitch contour data containing a plurality of pitch values representative of an audio segment in time, and wherein the pitch contour data in the audio segment in time is approximated by a plurality of consecutive sub-segments in the audio segment, each of said sub-segments defined by a first end point and a second end point, so as to allow the audio segment to be constructed based on the end points defining the sub-segments; and an input for receiving audio data indicative of the end points and for providing the audio data to the decoder.

According to one embodiment of the present invention, the audio data is recorded in an electronic medium, and the input is operatively connected to the electronic medium for receiving the audio data.

According to another embodiment of the present invention, the audio data is transmitted through a communication channel, and the input is operatively connected to the communication channel for receiving the audio data.

The electronic device can be a mobile terminal or a module for terminal.

According to the sixth aspect of the present invention, there is provided a communication network, comprising:

a plurality of base stations; and a plurality of mobile stations communicating with the base stations, wherein at least one of the mobile stations comprises:

a decoder for reconstructing an audio signal, wherein the audio signal is encoded for providing parameters indicative of the audio signal, the parameters including pitch contour data containing a plurality of pitch values representative of an audio segment in time, and wherein the pitch contour data in the audio segment in time is approximated by a plurality of consecutive sub-segments in the audio segment, each of said sub-segments defined by a first end point and a second end point, so as to allow the audio segment to be constructed based on the end points defining the sub-segments; and an input for receiving audio data indicative of the end points from at least one of the base stations for providing the audio data to the decoder.

The present invention will become apparent upon reading the description taken in conjunction with FIGS. 2 to 6.

BEST MODE FOR CARRYING OUT THE INVENTION

Figure 1:
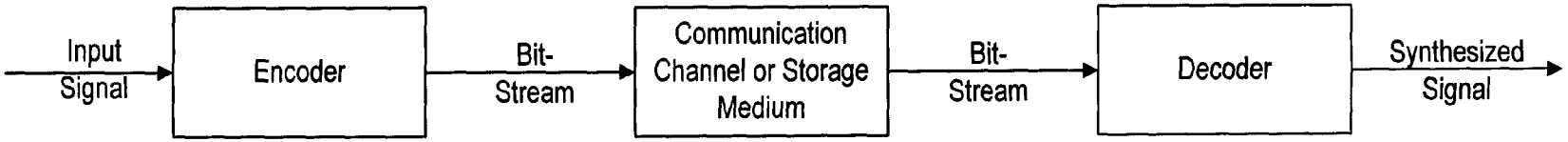
FIG. 1 is a block diagram showing a prior art speech coding system.

With a piece-wise linear pitch contour, only those points of the contour where there are derivative changes are transmitted to the decoder. Accordingly, the update rate required for the pitch parameter is significantly reduced. In principle, the piece-wise linear contour is constructed in such a manner that the number of derivative changes is minimized while maintaining the deviation from the "true pitch contour" below a pre-specified limit. To obtain globally optimal results, the lookahead should be very long and the optimization would require large amounts of computation. However, very good results can be achieved with the very simple technique described in this section. The description is based on an implementation used in a speech coder designed for storage of pre-recorded audio messages.

A simple but efficient optimization technique for constructing the piece-wise linear pitch contour can be obtained by going through the process one linear segment at a time. For each linear segment, the maximum length line (that can keep the deviation from the true contour low enough) is searched without using knowledge of the contour outside the boundaries of the linear segment. Within this optimization technique, there are two cases that have to be considered: the first linear segment and the other linear segments.

The case of the first linear segment occurs at the beginning when the encoding process is started. In addition, if no pitch values are transmitted for inactive or unvoiced speech, the first segment after these pauses in the pitch transmission fall to this category. In both situations, both ends of the line can be optimized. Other cases fall in to the second category in which the starting point for the line has already been fixed and only the location of the end point can be optimized.

In the case of the first linear segment, the process is started by selecting the first two pitch values as the best end points for the line found so far. Then, the actual iteration is started by considering the cases where the ends of the line are near the first and the third pitch values. The candidates for the starting point for the line are all the quantized pitch values that are close enough to the first original pitch value such that the criterion for the desired accuracy is satisfied. Similarly, the candidates for the end point are the quantized pitch values that are close enough to the third original pitch value. After the candidates have been found, all the possible start point and end point combinations are tried out: the accuracy of linear representation is measured at each original pitch location and the line can be accepted as a part of the piece-wise linear contour if the accuracy criterion is satisfied at all of these locations. Furthermore, if the deviation between the current line and the original pitch contour is smaller than the deviation with any one of the other lines accepted during this iteration step, the current line is selected as the best line found so far. If at least one of the lines tried out is accepted, the iteration is continued by repeating the process after taking one more pitch value to the segment. If none of the alternatives is acceptable, the optimization process is terminated and the best end points found during the optimization are selected as points of the piece-wise linear pitch contour.

In the case of other segments, only the location of the end point can be optimized. The process is started by selecting the first pitch value after the fixed starting point as the best end point for the line found so far. Then, the iteration is started by taking one more pitch value into consideration. The candidates for the end point for the line are the quantized pitch values that are close enough to the original pitch value at that location such that the criterion for the desired accuracy is satisfied. After finding the candidates, all of them are tried out as the end point. The accuracy of linear representation is measured at each original pitch location and the candidate line can be accepted as a part of the piece-wise linear contour if the accuracy criterion is satisfied at all of these locations. In addition, if the deviation from the original pitch contour is smaller than with the other lines tried out during this iteration step, the end point candidate is selected as the best end point found so far. If at least one of the lines tried out is accepted, the iteration is continued by repeating the process after taking one more pitch value to the segment. If none of the alternatives is acceptable, the optimization process is terminated and the best end point found during the optimization is selected as a point of the piece-wise linear pitch contour.

Figure 4:
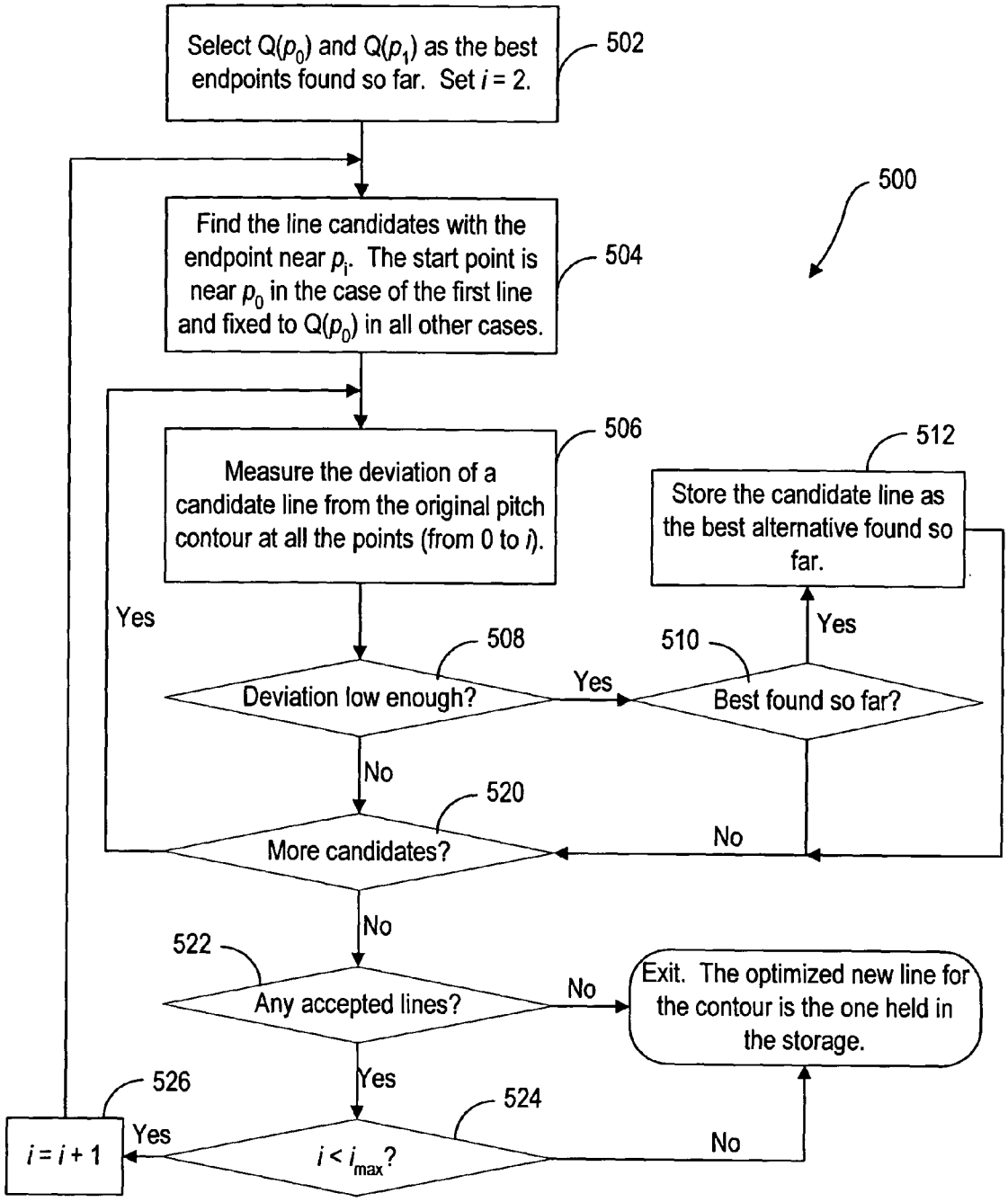
FIG. 4 is a flowchart illustrating an example of an iteration process for generating a piece-wise pitch contour.

In both cases described above in detail, the iteration can be finished prematurely for two reasons. First, the process is terminated if no more successive pitch values are available. This may happen if the whole lookahead has been used, if the speech encoding has ended, or if the pitch transmission has been paused during inactive or unvoiced speech. Second, it is possible to limit the maximum length of a single linear part in order to code the point locations more efficiently. For both cases, these issues can be taken into account by setting a limit $i_{max}$ to the iteration number i based on the number of pitch values available and on the maximum time-distance between the ends of the line. The iteration is shown in FIG. 4.

After finding a new point of the piece-wise linear pitch contour, the point can be coded into the bitstream. Two values must be given for each point: the pitch value at that point and the time-distance between the new point and the previous point of the contour. Naturally, the time-distance does not have to be coded for the first point of the contour. The pitch value can be conveniently coded using a scalar quantizer. In the implementation used in the coder designed for storage of audio menus, each time distance value is coded using $\lceil \log_2(i_{max}) \rceil$ bits. If desired, it is also possible to use some lossless coding, such as Huffman coding, on the time distance values. The pitch values are coded using scalar quantization. The scalar quantizer contained 32 levels (5 bits) obtained using $$p(n) = p(n-1) + \max\left(2, \frac{480p(n-1)}{8000}\right),$$

where n runs from 2 to 32 and p(1)=19 samples. Thus, more distortion is allowed for low pitch frequencies, to take into account the properties of human hearing. Moreover, the known features of the human auditory system are exploited by performing the distortion measurements during the pitch quantization in the logarithmic domain.

Figure 2:
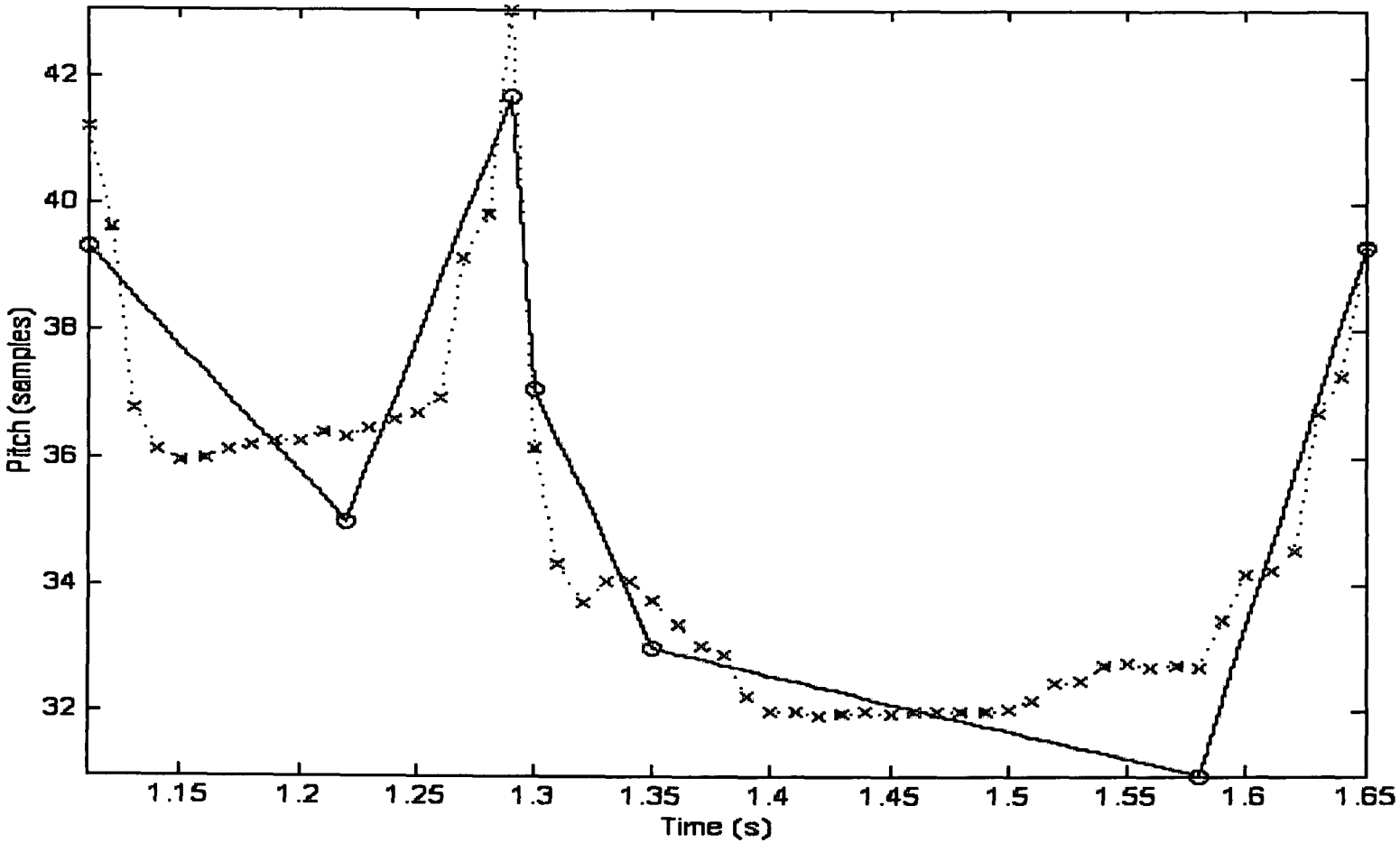
FIG. 2 is an example of a piece-wise pitch contour according to one embodiment of the present invention.

An example of the piece-wise pitch contour, according to the present invention, along with the original pitch contour is shown in FIG. 2. As shown in FIG. 2, each linear segment is a straight line joining two points: a starting point and an end point. For example, the second line segment of the piece-wise pitch contour shown in FIG. 2 is the straight line joining a point at t=1.22s and a point at t=1.29s. The number of pitch values in the time period from t=1.22s and t=1.29s is 8, including the starting point and the end point.

Figure 3:
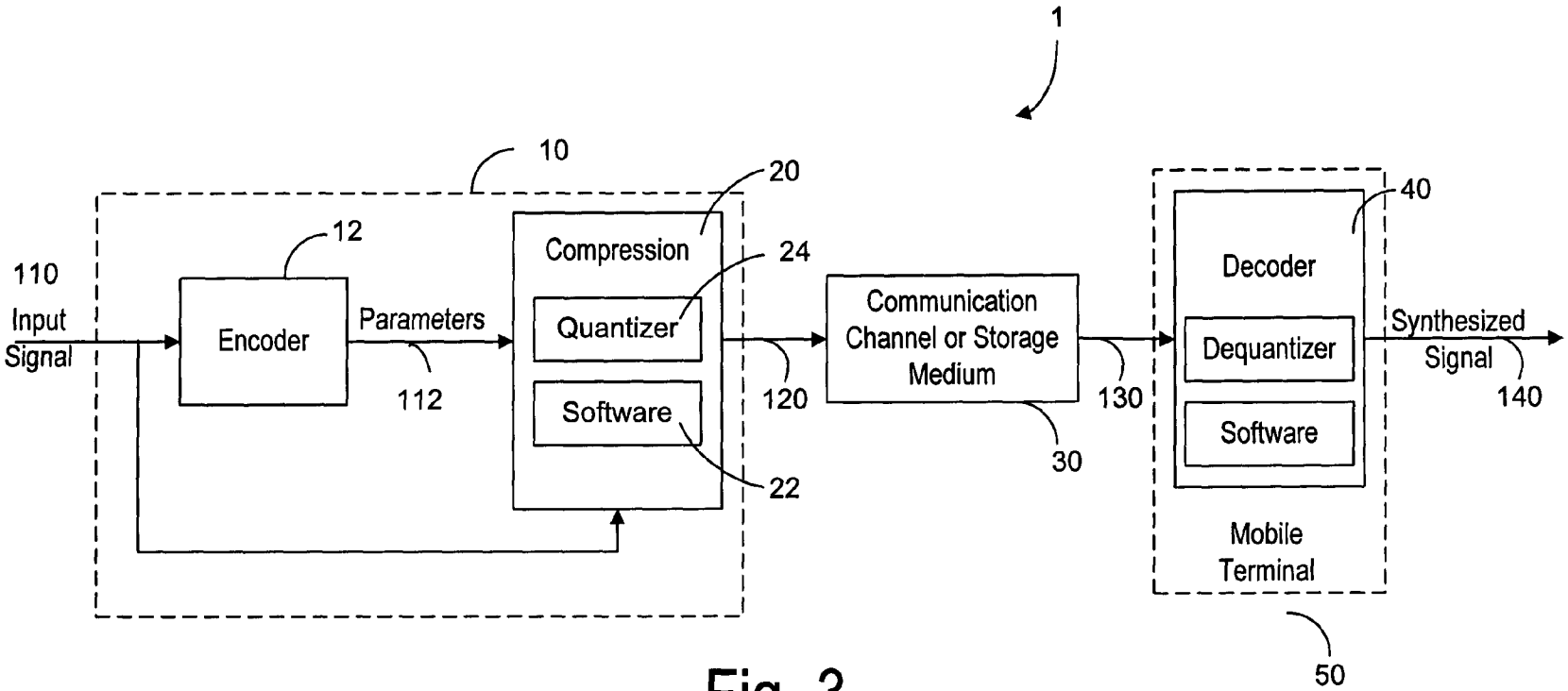
FIG. 3 is a block diagram showing a speech coding system, according to one embodiment of the present invention.

In order to carry out the present invention, the speech coding system has an additional module for piece-wise pitch contour generation. As shown in FIG. 3, the speech coding system 1 comprises an encoding module 10, which has a parametric speech coder 12 for processing the input speech signal in a plurality of segments. For each segment, the coder 12 determines a parametric representation 112 of the input signal. The parameters can be quantized or unquantized versions of the original parameters, depending on the speech coding system. A compression module 20, responsive to the parametric representation, reduces the pitch contour into a piece-wise pitch contour using e.g. a software program 22. The points on the piece-wise contour are then coded by a quantization module 24 into the bitstream 120 through a communication channel or stored in a storage medium 30. At the receiver end, a decoder 40 is used to generate a synthesized speech signal 140 based on the information in the received bitstream 130 indicative of the piece-wise pitch contour and other speech parameters.

The software program 22 in the piece-wise pitch contour generation module 20 contains machine readable codes that process the pitch values in the pitch contour according to the flowchart 500 as shown in FIG. 4. The flowchart 500 shows the iteration for selecting a straight line representing a linear segment of the piece-wise pitch contour (see FIG. 2). Each straight line has a starting point $Q(p_0)$ and an end point $Q(p_i)$. For the first linear segment, both the starting point $Q(p_0)$ and the end point $Q(p_i)$ have to be selected. For all other linear segments, only the end point $Q(p_i)$ has to be selected. The iteration starts at selecting a linear segment covering a time period that includes three pitch values. Thus, if the starting point is located at a first point in time and the end point is located at a second point in time, then there are three pitch values in the time period from the first point in time to the second point in time. Thus, i=2 is set at step 502. At step 504, the end point is selected to be a point near or on the pitch value at the second point in time. For the first linear segment, the starting point is selected to be a point near or on the pitch value at the first point in time. At step 506, the deviation between each of the pitch values in the time period from the first point in time to the second point in time and the straight line joining the starting point and the end point and is measured. Alternatively the deviation can be measured with certain intervals. At step 508, the deviation is compared with a predetermined error value in order to determine whether the current straight line is acceptable as a candidate. If the deviation at some pitch values within the time period exceeds the predetermined error value, the end point (along with the starting point if the linear segment is the first segment) is adjusted and the iteration process loops back to step 506 until no adjustment is possible. If the current straight line is acceptable as determined at step 508, it is compared to the earlier results at step 510 in order to determine whether it is the best straight line so far. The best straight line so far is the one with the smallest sum of the absolute deviations among the straight lines with the same i already obtained so far. The best line so far is stored at step 512. The end point is again adjusted at step 520 until no adjustment is possible.

When adjustment is no longer possible, as determined at step 520, it is time to determine whether to stop the iteration process and use the best line stored at step 512 as the current line segment, or to extend the line segment further by increasing i by 1 at step 526 (unless the current i is already equal to $i_{max}$ as determined at step 524). It is possible that, after increasing i by 1, no extended line is acceptable as determined at step 522. In that case, the best line with the previous i is used as straight line for the current segment. The number of candidates can be limited e.g. by setting a maximum limit for how much the endpoint can differ from the sample value. The intervals between different endpoint candidates can also be set to limit the amount of possible candidates.

It should be noted that, in the pitch-wise pitch contour of FIG. 2, the third linear segment covers only two pitch values at t=1.29s and t=1.30s. That is because t=1.30s is the point in time separating two speech signal segments.

It should also be noted that the adjustment of the end point or the starting point can only be carried out in steps. For example, the adjustment of $Q(p_i)$ can be carried out by increasing or decreasing the value of $Q(p_i)$ by one quantization step. However, the adjustment can also be carried in smaller or larger steps. Furthermore, the limit of the longest line, or $i_{max}$, can be set at a large number, such as 64. In that case, the time period (and, therefore, i) between the starting point and the end point varies significantly. For example, i in the fourth line segment is equal to 5, while i in the fifth line segment is 23. However, if $i_{max}$ is set to 5, for example, then the time period (and i) in most or all linear segments is the same. Thus, this invention is applicable when i is variable and $i_{max}$ is variable or a fixed number. Also, the measured deviation between a segment candidate and the pitch values that is used to select the best candidate so far at step 510 can be the sum of absolute differences or other deviation measures. The generation of segment candidates may be limited by certain criteria, such as a pre-determined maximum absolute difference between each pitch value and the corresponding point in the segment candidate. For example, the maximum difference can be five or ten quantization steps, but it can be a smaller or a larger number.

Furthermore, the present invention as described above can be modified without departing the basic concept of modified pitch contour quantization. First, different optimization techniques can be used. Second, the modified pitch contour does not have to be piece-wise linear as long as the number of pitch values to be transmitted can be kept low. Third, the quantization techniques used for coding the pitch values and the time distances can be modified. Fourth, it is possible to construct the alternative pitch contour already during pitch estimation.

Moreover, the embodiment described above is not by any means the only implementation alternative. For example, the optimization technique used in determining the new pitch contour can be freely selected. In addition, the new pitch contour does not have to be piece-wise linear. For example, it is possible to describe the contour using splines, polynomials, discrete cosine transform etc. For example, a non-linear contour can have the following general form:

$$Q(p)=Q(p_0)+a_1[(Q(p_i)-Q(p_0)/(t_i-t_0)](t-t_0)+a_2[(Q(p_i)-Q(p_0)/(t_i-t_0)]^2(t-t_0)^2+\ldots\ t_1>t\geqq t_0$$

In this case, while the end points are updated as needed, it is sufficient to provide the algorithm to the decoder only once.

General Discussion

The search for the optimal simplified model of the pitch contour can be formulated as a mathematical optimization problem. Let f(t) denote the function that describes the original pitch contour in the range from 0 to $t_{max}$. Furthermore, let g(t) denote the simplified pitch contour and d(f(t), g(t)) denote the deviation between the two contours at time instant t. Now, the optimization problem to be solved is to find the simplified pitch contour g(t) that satisfies two optimality conditions:

(I) The number of bits needed for describing the contour g(t) is minimized.

(II) $d(f(t), g(t))\leqq h(f(t))$ for all $0\leqq t\leqq t_{max}$, where h(•) defines the maximum allowable deviation from the original pitch contour. From the set of contours that satisfy both conditions, the contour function that minimizes the total deviation, $$D=\int_{t=0}^{t_{max}} d(f(t), g(t)), \tag{1}$$

is selected as the final simplified contour.

In general, the above optimization problem is unsolvable. However, the problem can be solved if its generality is reduced by fixing the pitch contour model. For example, in a piece-wise linear model, the function g(t) can be described using the points in which the derivative of g(t) changes. Let $q_n$ and $t_n$ denote the coordinates of the nth such point ($1\leqq n\leqq N$, where N is the number of these points in the piece-wise linear model). The simplified contour can be defined in N−1 linear pieces as $$g(t)=q_n+\frac{t-t_n}{t_{n+1}-t_n}(q_{n+1}-q_n)\ \text{for}\ t_n\leq t\leq t_{n+1}, \tag{2}$$

where $1\leqq n\leqq N-1$. To make the definition complete, it is required that $t_n<t_{n+1}$, and that $t_1=0$ and $t_N=t_{max}$. In addition, it is required that all values of $q_n$ are within the finite range from $q_{min}$ to $q_{max}$. With this model, the optimization problem reduces to the search for the set of points ($t_n$, $q_n$) that describes the contour g(t) that satisfies the conditions (I) and (II) and minimizes the total deviation in Eq. 1. Now, by making the reasonable assumption that the point coordinates can only be represented with a limited resolution, the problem becomes solvable since the points are located in a grid with a finite number of possible point locations. This assumption does not reduce the generality of the formulation since the finite accuracy follows directly from the optimality condition (I).

Solutions for the Problem

The optimization problem formulated in the last section can be solved in many ways. Here, two solutions are described. The first one is computationally burdensome but is always capable of finding the global optimum whereas the second solution is very simple but produces only sub-optimal results. In both solutions, we assume that the pitch values $q_n$ are coded into bits using a scalar quantizer with a codebook $C=\{c_1, c_2, \ldots, c_M\}$, and that the time indices $t_n$ are integer multiples of some time unit T. Furthermore, we assume that both C and T are selected in such a manner that a solution exists, and make the reasonable additional assumption that the number of bits needed for describing the contour can be minimized by minimizing N (the number of points needed for defining the simplified contour).

Globally Optimal Approach

The globally optimal solution can be achieved using the following straightforward brute force algorithm:

Step 1. Initialization. Set N=1.

Step 2. Set N=N+1. Can we find a suitable piece-wise linear model with the current N? If yes, then go to Step 3. Otherwise, repeat Step 2.

Step 3. Exit and code the simplified contour. If there are several suitable contour candidates, select the one that minimizes the total deviation in Eq. 1.

The test in Step 2 can be performed by checking all suitable piece-wise linear contour candidates (with the current N) against the optimality condition (II). During the first iteration (N=2), the candidates are all the lines with the endpoints ($t_1$, $q_1$) and ($t_2$, $q_2$) that satisfy the condition $$d(f(t_n),q_n)\leqq h(f(t_n)). \tag{3}$$

In this case, the time indices are fixed to $t_1=0$ and $t_2=t_{max}$. The values of $q_1$ and $q_2$ are selected from the codebook C, and thus there is only a limited number of candidates. During the second iteration (N=3), the contour candidates have two (N−1) linear pieces. This time the first and the last time indices ($t_1$ and $t_3$) are fixed to 0 and $t_{max}$ whereas the time index $t_2$ can be adjusted in the range from T to $t_{max}$−T with steps of T. Again, the values of $q_n$ are selected from the codebook C. Similarly, with some arbitrary N the simplified contour consists of N−1 linear pieces and N−2 of the time indices can be adjusted.

It is easy to see that the above algorithm always finds the optimal contour candidate since the check in Step 2 takes care of the condition (II), the iterative process guarantees that the condition (I) is satisfied, and the total deviation is minimized in Step 3. However, it is also easy to see that the complexity of this algorithm grows extremely fast with increasing problem size. More precisely, we can state that in the worst case the algorithm goes through $$g=\sum_{j=0}^{m}\frac{b^{j+2}m!}{j!(m-j)!} \tag{4}$$

different contour candidates. In the above equation, b denotes the maximum number of codebook entries that can satisfy the condition of Eq. 3 and $m=(t_{max}/T)-1$.

In a practical situation, these variables could be, for example, b=3 and m=62, leading to about $1.9 \cdot 10^{38}$ contour candidates in the worst case. Consequently, it can be concluded that this theoretically optimal approach can only be used when b and m are small (for example, when b=3 and m=8, the worst-case number of candidates is 589824) and thus this approach is not suitable for most practical implementations.

Simple Sub-Optimal Approach

As demonstrated earlier, the optimization process may require large amounts of computation if the target is to always find the globally optimal piece-wise linear contour. However, quite good results can be achieved with the very simple and computationally efficient technique (in which the complexity grows only linearly with increasing problem size) described in this section. In addition to its simplicity, one advantage of this approach is that the whole pitch contour is not processed at once but instead only a relatively small look-ahead is required.

The main idea in the simplified approach is to go through the optimization process one linear piece at a time. For each linear piece, the maximum length line that can keep the deviation from the true contour low enough is searched without using knowledge of the contour outside the boundaries of the linear piece. Within this optimization technique, there are two cases that have to be considered separately: the first linear piece and the other linear pieces. The case of the first linear piece occurs at the beginning when the encoding process is started. In addition, if no pitch values are transmitted for inactive or unvoiced speech, the first linear pieces after these pauses in the pitch transmission fall to this category. In both situations concerning the first linear piece, both ends of the line are optimized. Other cases fall in to the second category in which the starting point for the line has already been fixed in the optimization of the previous linear piece and thus only the location of the end point is optimized.

In the case of the first linear piece, the process starts by selecting the quantized pitch values at the time indices 0 and T as the best end points for the line found so far. Then, the actual iteration begins by considering the cases where the ends of the line are close enough to the original pitch values at time indices 0 and 2T. In other words, the candidates for the start point are all the quantized pitch values that are close enough to the original pitch value at $t_1=0$ such that the criterion for the desired accuracy (given in Eq. 3) is satisfied. Similarly, the candidates for the end point are the quantized pitch values that are close enough to the original pitch value at $t_2=2T$. After the candidates have been found, all the possible start point and end point combinations are tried out: the accuracy of the linear representation is measured in the time interval between $t_1$ and $t_2$, and the candidate line can be accepted as a part of the piece-wise linear contour if the accuracy criterion is satisfied. Furthermore, if the deviation from the original pitch contour is smaller than with the other lines accepted during this iteration step, the line is selected as the best line found so far. If at least one of the candidates is accepted, the iteration is continued by repeating the process after increasing $t_2$ by a step of size T. If none of lines is accepted, the optimization process is terminated and the best end points found during the previous iteration are selected as the first points of the piece-wise linear pitch contour.

In the case of other linear pieces, only the location of the end point can be optimized since the start point has already been fixed during the optimization of the previous linear piece. The process is started by selecting the quantized pitch value located an interval of T after the fixed starting point as the best end point for the line found so far. (Let $(t_{n-1}, q_{n-1})$ and $(t_n, q_n)$ denote the fixed start point and the end point to be optimized, respectively.) Then, the iteration is started by taking one more time step into the consideration, i.e. $t_n=t_{n-1}+2T$. The candidates for the end point for the line are the quantized pitch values that are close enough to the original pitch value at the new $t_n$ such that the criterion for the desired accuracy is satisfied. After finding the candidates, the rest of the process is similar to the case of the first linear piece.

Figure 5:
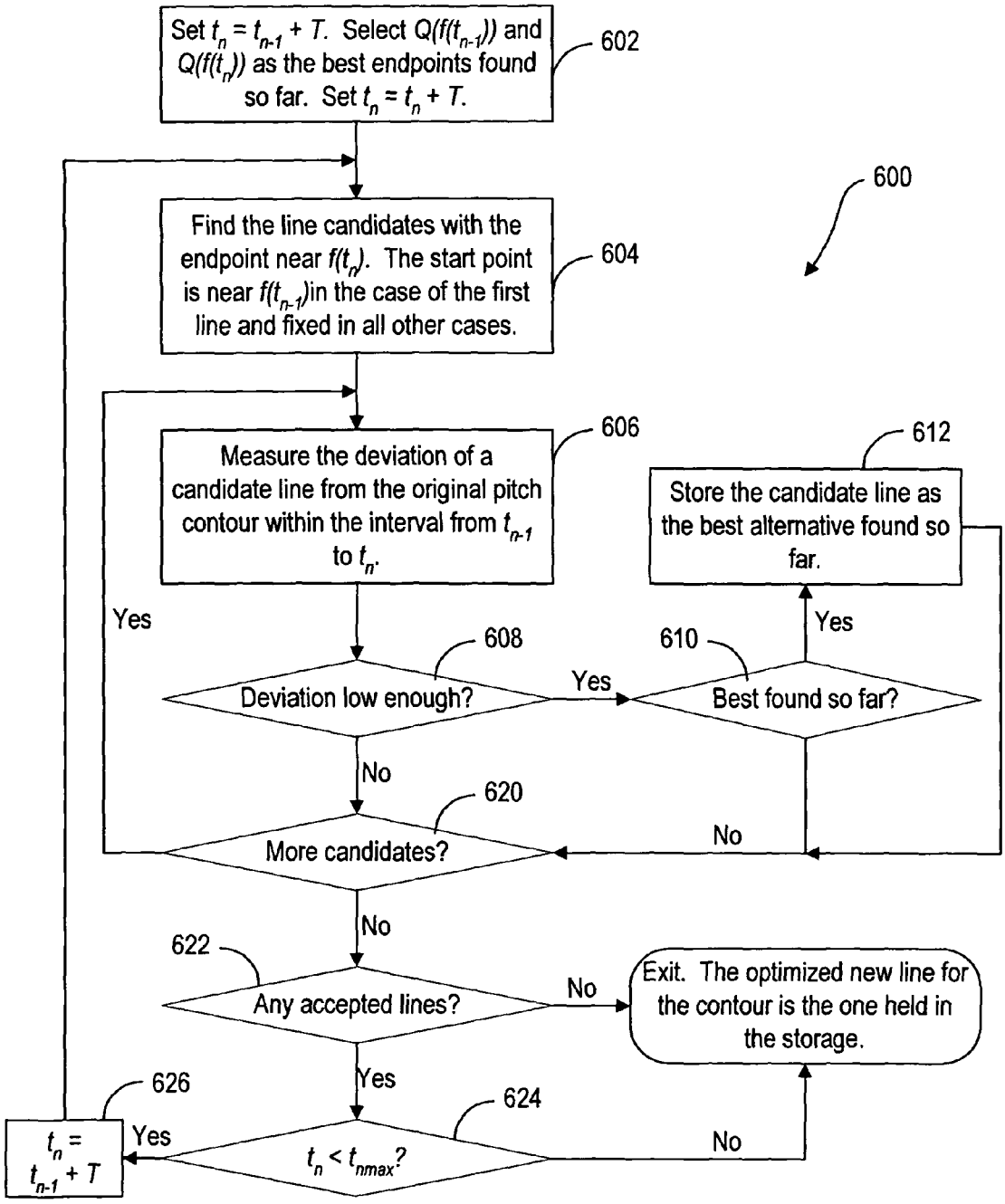
FIG. 5 is a flowchart illustrating an example of an iteration process for generating a piece-wise pitch contour based on an optimal simplified model.

In both cases described above in detail, the iteration can be finished prematurely for two reasons. First, the process is terminated if $t_n$ cannot be increased because the original pitch contour ends before $t_n+T$. This may happen if the whole look-ahead buffer has been used, if the speech signal to be encoded has ended, or if the pitch transmission has been paused during inactive or unvoiced speech. Second, it is possible to limit the maximum length of a single linear part in order to code the time indices of the points more efficiently. For both cases, these issues can be taken into account by setting a limit $t_{nmax}$ based on the duration of the available pitch contour and on the maximum time-distance between the ends of the line. This approach is illustrated in flowchart 600 in the FIG. 5, which shows the optimization process for one linear piece.

The flowchart 600 shows the iteration for selecting a straight line representing one linear segment of the piece-wise pitch contour. The straight line has a starting point $Q(f(t_{n-1}))$ and an end point $Q(f(t_n))$. For the first linear segment, both the starting point $Q(f(t_{n-1}))$ and the end point $Q(f(t_n))$ have to be selected. For all other linear segments, only the end point $Q(f(t_n))$ has to be selected. The iteration starts at selecting a linear segment starting at $t_n=t_{n-1}+T$. The starting point $Q(f(t_{n-1}))$ and the end point $Q(f(t_{n-}))$ are considered as the best end points so far. Thus, at step 602, set $t_n=t_n+T$. At step 604, the end point is selected to be a point near $f(t_n)$. For the first linear segment, the starting point is near $f(t_{n-1})$. For all other segments, the starting point is fixed. At step 606, the deviation between the candidate line and each of the pitch values in the time period from $t_{n-1}$ to $t_n$ is measured. At step 608, the deviation is compared with a predetermined error value in order to determine whether the current straight line is acceptable as a candidate. If the deviation at some pitch values within the time period exceeds the predetermined error value, the end point (along with the starting point if the linear segment is the first segment) is adjusted and the iteration process loops back to step 606 until no adjustment is possible. If the current straight line is acceptable as determined at step 608, it is compared to the earlier results at step 610 in order to determine whether it is the best straight line so far. The best straight line so far is the one with the smallest sum of the absolute deviations among the straight lines with the same i already obtained so far. The best line so far is stored at step 612. The end point is again adjusted at step 620 until no adjustment is possible.

When adjustment is no longer possible, as determined at step 620, it is time to determine whether to stop the iteration process and use the best line stored at step 612 as the current line segment, or to extend the line segment further by increasing $t_n$ by T at step 626 (unless the current $t_n$ is already equal to $t_{max}$ as determined at step 624). It is possible that, after increasing $t_n$ by T, no extended line is acceptable as determined at step 622. In that case, the best line with the previous $t_n$ is used as straight line for the current segment. The number of candidates can be limited e.g. by setting a maximum limit for how much the endpoint can differ from the sample value. The intervals between different endpoint candidates can also be set to limit the amount of possible candidates.

Practical Implementation

The pitch contour quantization technique introduced in this paper is included in a practical speech coder designed for storage applications. The coder operates at very low bit rates (about 1 kbps) and processes the 8 kHz input speech in segments of variable duration (between 20 and 640 ms). In the practical implementation, the simple sub-optimal approach is used and only the pitch contour located in the current segment is considered in the optimization. During unvoiced or inactive segments, no pitch information is coded. The variable T is set to 10 ms that is equal to the pitch estimation interval. Furthermore, the continuous pitch contour is approximated using the discrete contour formed by the estimated pitch values $p_k$ (at 10 ms intervals). Consequently, the optimality condition (II) is changed into $$d(p_k, g(kT)) \leqq h(p_k) \text{ for all } 0 \leqq k \leqq t_{max}/T. \quad (5)$$

In addition, the minimization of the total distortion in Eq. 1 is approximated with the minimization of $$\tilde{D} = \sum_{k=0}^{t_{max}/T} d(p_k, g(kT)), \quad (6)$$

where the function d is defined as the absolute error, i.e. $d(x,y)=|x-y|$.

The function h that defines the maximum allowable coding error for a given pitch value is determined as $$h(p_k)=\max(2,480p_k/8000). \quad (7)$$

The same function is also used in the generation of the codebook C used in scalar quantization of the pitch values $q_n$. The entries of the 32-level (5-bit) codebook C are computed using $c_j=c_{j-1}+h(c_{j-1})$ with $c_1=19$. This codebook covers the pitch period range used in the coder and is quite consistent with the experimental findings. Moreover, this codebook and function h approximately follow the theory of critical bands in the sense that the frequency resolution of the human ear is assumed to decrease with increasing frequency. To further enhance the perceptual performance, the quantization is done in logarithmic domain.

The time indices are coded for one segment at a time using differential quantization, with the exception that the time-distance is not coded at all for the first point of each segment since $t_1$ is always 0. In the differential coding scheme, a given time index is coded using the time-distance between it and the previous time index in steps of size T. More precisely, the value of a given $t_n$ is coded by converting $((t_n-t_{n-1})/T)-1$ into the binary representation containing $\lceil \log_2(i_{max}-1) \rceil$ bits, where $i_{max}$ denotes the maximum length that would have been allowed for the current linear piece. One additional trick is used in our implementation to increase coding efficiency: If the number of time indices to be coded is more than half of the number of pitch estimation instants in the segment, the "empty" time indices are coded instead of the time indices $t_n$ (and one bit is used to indicate which coding scheme is used). However, it should be noted that the efficiency of this trick is enabled by the segmental processing used in the storage coder implementation. In a general case with continuous frame-based processing, a better way would be to use some lossless coding technique, such as Huffman coding, directly on the time distance values.

The implementation described above is capable of coding the pitch contour with the average bit rate of approximately 100 bps in such a manner that the deviation from the original contour remains below the maximum allowable deviation defined in Eq. 7. Despite the very low bit rate, the coded pitch contour is quite close to the original contour. The average and the maximum absolute coding errors are about 1.16 and 5.12 samples, respectively, at 99 bps. When judged by expert listeners, the coded contour could be easily distinguished from the original contour but the coding error is not particularly annoying. The pitch quantization technique has not been tested explicitly with naive listeners; however, a formal listening test indicated that the storage coder containing the proposed pitch quantization technique outperformed a 1.2 kbps state-of-the-art reference coder by a wide margin despite the average bit rate reduction of more than 200 bps (for the pitch alone, the reduction is about 70 bps).

In sum, the present invention exploits the fact that a typical pitch contour evolves fairly smoothly but contains occasional rapid changes in order to construct a piece-wise linear pitch contour that closely follows the shape of the original contour but contains less information to be coded. For example, only the points of the piece-wise linear pitch contour where the derivative changes are quantized. During unvoiced speech, a constant default pitch value can be used both at the encoder and at the decoder. Furthermore, the properties of human hearing are exploited by allowing larger deviations from the true pitch contour in cases where the pitch frequency is low. The present invention offers a substantial reduction in the bit rate required for perceptually sufficient quantization accuracy: with the proposed quantization technique an accuracy level close to that of a conventional pitch quantizer operating at 500 bps (5-bit quantizer, 100 pitch values per second) can be reached at an average bit rate of about 100 bps. If lossless compression is used to supplement the method described in this invention report, it is possible to even further reduce the bit rate to about 80 bps, for example.

The main utilities of the invention include:

It is possible to use a significantly lower average update rate than with the prior-art techniques.

The piece-wise linear pitch contour can be reconstructed at the decoder in such a manner that it is very close to the true pitch contour.

The invention takes into account the fact that the human ear is more sensitive to pitch changes when the pitch frequency is low.

The technique enables considerable reductions in the bit rate.

The invention can be implemented as an additional block that can be used with existing speech coders.

Figure 6:
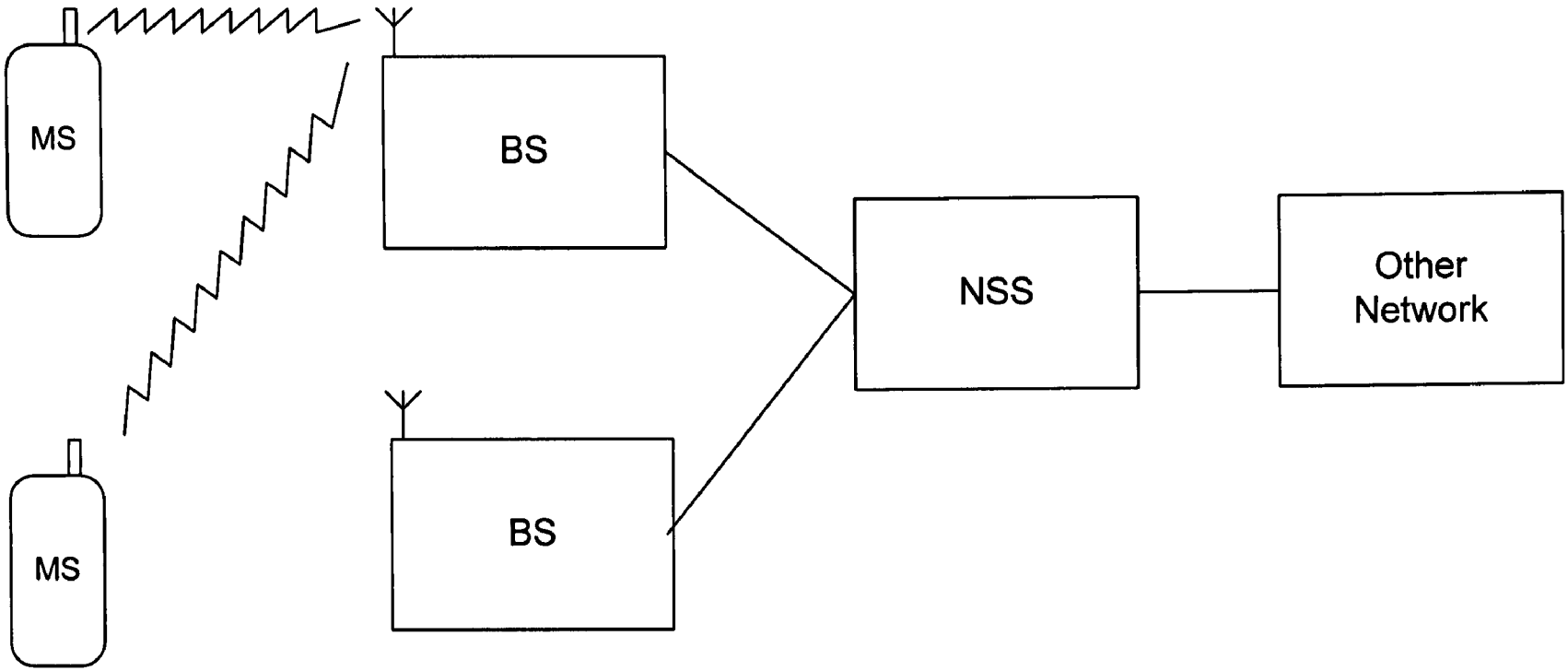
FIG. 6 is a schematic representation showing a communication network capable of carrying out the present invention.

The present invention is suitable for storage applications and it has been successfully used in a speech coder designed for pre-recorded audio messages. In the target application, the audio messages (audio menus) are recorded and encoded off-line on a computer. The resulting low-rate bitstream can then be stored and decoded locally in a mobile terminal. The low-rate bitstream can be provided by a component in a communication network, as shown in FIG. 6. FIG. 6 is a schematic representation of a communication network that can be used for coder implementation regarding storage of pre-recorded audio menus and similar applications, according to the present invention. As shown in the figure, the network comprises a plurality of base stations (BS) connected to a switching sub-station (NSS), which may also be linked to other networks. The network further comprises a plurality of mobile stations (MS) capable of communicating with the base stations. The mobile station can be a mobile terminal, which is usually referred to as a complete terminal. The mobile station can also be a module for terminal without a display, keyboard, battery, cover etc. The mobile station may have a decoder 40 for receiving a bitstream 120 from a compression module 20 (see FIG. 3). The compression module 20 can be located in the base station, the switching sub-station or in another network.

Although the invention has been described with respect to a preferred embodiment thereof, it will be understood by those skilled in the art that the foregoing and various other changes, omissions and deviations in the form and detail thereof may be made without departing from the scope of this invention.

What is claimed is:

1. A method for coding an audio signal, comprising:

receiving pitch contour data indicative of the audio signal, the pitch contour data comprising a plurality of pitch values obtained from an audio segment at a plurality of sampling points at regular time intervals;

creating, in response to the pitch contour data obtained at said regular time intervals, a plurality of pitch contour segment candidates, each segment candidate corresponding to a sub-segment of the audio signal, wherein each sub-segment has a start-point pitch value and an end-point pitch value selected from said plurality of pitch values and each segment candidate has a start-segment pitch value at a start segment point and an end-segment pitch value at an end segment point, the start segment point aligned with the sampling point of the start-point pitch value and the end segment point aligned with the sampling point of the end-point pitch value;

measuring deviation between each of the pitch contour segment candidates and said pitch values in the corresponding sub-segment;

selecting, among said segment candidates, a plurality of consecutive simplified contour segments to represent the audio segment based on the measured deviations and one or more pre-selected criteria, wherein the start-segment pitch values at the start segment points of at least some simplified contour segments are different from the start-point pitch values of the corresponding sub-segments and the end-segment pitch values at the end segment points of at least some simplified contour segments are different from the end-point pitch values of the corresponding sub-segments, wherein each of the simplified contour segments is selected from a corresponding group of segment candidates, and wherein the simplified contour segments comprise a first contour segment and a plurality of subsequent contour segments, and wherein, in said creating, the start-segment pitch value of the group of segment candidates corresponding to each of the subsequent contour segments is the same as the end-segment pitch value of the simplified contour segment immediately preceding said each of the subsequent contour segments, and the start-segment pitch value of the group of segment candidates corresponding to the first contour segment is selected based on the start-segment pitch value of the sub-segment corresponding to first contour segment, and wherein the sub-segment corresponding to the first contour segment is representative of the pitch contour data first available after an inactive or unvoiced speech or at the beginning of an encoding process;

coding the sub-segment of the audio signal corresponding to the simplified contour segment with characteristics of the simplified contour segment.

2. The method according to claim 1, wherein each of the start segment points in said plurality of consecutive simplified contour segments is separated by a time distance from an immediately following start segment point, and wherein said coding comprises providing information indicative of the start-segment pitch value at the start segment point and the time distance between the start segment point and the immediately following start segment point so as to allow a decoder to reconstruct the audio signal in the audio sub-segment based on the information.

3. The method according to claim 2, wherein at least one of the selected candidates is a linear segment.

4. The method according to claim 2, wherein at least one of the selected candidates is a non-linear segment.

5. The method according to claim 1, wherein the number of pitch values in some of the consecutive sub-segments is equal to or greater than 3.

6. The method according to claim 1, wherein said creating is limited by a pre-selected condition such that the deviation between each of the simplified pitch contour segment candidates and each of said pitch values in the corresponding sub-segment is smaller than or equal to a pre-determined maximum value.

7. The method according to claim 6, wherein the created segment candidates have various lengths, and said selecting is based on the lengths of the segment candidates, and the pre-selected criteria include that the selected candidate has the maximum length among the segment candidates.

8. The method according to claim 6, wherein said selecting is based on the lengths of the segment candidates, and the pre-selected criteria include that the measured deviation is minimum among a group of the candidates having the same length.

9. The method according to claim 1, wherein said creating is carried out by adjusting the end segment point of the segment candidates.

10. The method according to claim 1, wherein the audio signal comprises a speech signal.

11. An apparatus comprising:

an input end for receiving pitch contour data, the pitch contour data comprising a plurality of pitch values obtained from an audio segment of an audio signal at a plurality of sampling points at regular time intervals; and a data processing module, responsive to the pitch contour data obtained from said regular time intervals, for generating a plurality of pitch contour segment candidates, each segment candidate corresponding to a sub-segment of the audio signal, wherein each sub-segment has a start-point pitch value and an end-point pitch value selected from said plurality of pitch values and each segment candidate has a start-segment pitch value at a start segment point and an end-segment pitch value at an end segment point, the start segment point aligned with the sampling point of the start-point pitch value and the end segment point aligned with the sampling point of the end-point pitch value, and wherein the processing module is configured to measure deviation between each of the pitch contour segment candidates and said pitch values in the corresponding sub-segment; and to select, among said segment candidates, a plurality of consecutive simplified contour segments to represent the audio segment based on the measured deviations and pre-selected criteria, wherein the start-segment pitch values at the start segment points of at least some selected segment candidates are different from the start-point pitch values of the corresponding sub-segments and the end-segment pitch values at the end segment points of at least some simplified contour segments are different from the end-point pitch values of the corresponding sub-segments, wherein each of the simplified contour segments is selected from a corresponding group of segment candidates, and wherein the simplified contour segments comprise a first contour segment and a plurality of subsequent contour segments, and wherein, in said generating, the start-segment pitch value of the group of segment candidates corresponding to each of the subsequent contour segments is the same as the end-segment pitch value of the simplified contour segment immediately preceding said each of the subsequent contour segments, and the start-segment pitch value of the group of segment candidates corresponding to the first contour segment is selected based on the start-segment pitch value of the sub-segment corresponding to first contour segment, and wherein the sub-segment corresponding to the first contour segment is representative of the pitch contour data first available after an inactive or unvoiced speech or at the beginning of an encoding process.

12. The apparatus according to claim 11, further comprising a quantization module configured to code the sub-segment of the audio signal corresponding to the simplified contour segment with characteristics of the simplified contour segment.

13. The apparatus according to claim 12, wherein the quantization module also configured to provide audio data indicative of the coded sub-segment, said coding device further comprising a storage device, operatively connected to the quantization module to receive the audio data, for storing the audio data in a storage medium.

14. The apparatus according to claim 12, further comprising an output end, operatively connected to a storage medium, for providing audio data indicative of the coded sub-segment to the storage medium for storage.

15. The apparatus according to claim 12, further comprising an output end for transmitting audio data indicative of the coded sub-segment to the decoder so as to allow the decoder to reconstruct the audio signal based on the audio data.

16. A non-transitory computer readable storage medium embodied with a software program for use in an encoding module, said software program comprising programming codes, when executed by a processor, perform the method according to claim 1.

17. An apparatus comprising:

an input for receiving audio data indicative of a plurality of consecutive simplified contour segments, the consecutive simplified contour segments selected from a plurality of pitch contour segment candidates, wherein the pitch contour segment candidates are generated in response to pitch contour data comprising a plurality of pitch values obtained from an audio segment of an audio signal at a plurality of sampling points at regular time intervals, each segment candidate corresponding to a sub-segment of the audio signal, wherein each sub-segment has a start-point pitch value and an end-point pitch value selected from said plurality of pitch values and each segment candidate has a start segment point and an end segment point, the start segment point aligned with the sampling point of the start-point pitch value and the end segment point aligned with the sampling point of the end-point pitch value, and wherein the plurality of consecutive simplified contour segments are selected among said segment candidates based on pre-selected criteria and on deviation between each of the segment candidate and said pitch values in the corresponding sub-segment, and wherein each of the simplified segments is defined by a first end point having a first pitch value and a second end point having a second pitch value, and wherein the first pitch values at the first end points of at least some simplified segments are different from the start-point pitch values of the corresponding sub-segments and the second pitch values at the second end points of at least some simplified segments are different from the end-point pitch values of the corresponding sub-segments, and wherein the received audio data comprises the end points defining the sub segments, wherein each of the simplified contour segments is selected from a corresponding group of segment candidates, and wherein the simplified contour segments comprise a first contour segment and a plurality of subsequent contour segments, and wherein, in generating the pitch contour segment candidates, the start-segment pitch value of the group of segment candidates corresponding to each of the subsequent contour segments is the same as the end-segment pitch value of the simplified contour segment immediately preceding said each of the subsequent contour segments, and the start-segment pitch value of the group of segment candidates corresponding to the first contour segment is selected based on the start-segment pitch value of the sub-segment corresponding to first contour segment, and wherein the sub-segment corresponding to the first contour segment is representative of the pitch contour data first available after an inactive or unvoiced speech or at the beginning of an encoding process; and a reconstructing module configured to reconstruct the audio segment based on the received audio data.

18. The apparatus according to claim 17, wherein the audio data is recorded on an electronic media, and wherein the input is operatively connected to electronic media for receiving the audio data.

19. The apparatus according to claim 17, wherein the audio data is transmitted through a communication channel, and wherein the input is operatively connected to the communication channel for receiving the audio data.

20. The apparatus according to claim 17, comprising a mobile terminal.

21. A communication network, comprising:

a plurality of base stations; and a plurality of mobile stations communicating with the base stations, wherein at least one of the mobile stations comprises:

an input for receiving audio data indicative of a plurality of consecutive simplified contour segments, the consecutive simplified contour segments selected from a plurality of pitch contour segment candidates, wherein the pitch contour segment candidates are generated in response to pitch contour data comprising a plurality of pitch values obtained from an audio segment of an audio signal at a plurality of sampling points at regular time intervals, each segment candidate corresponding to a sub-segment of the audio signal, wherein each sub-segment has a start-point pitch value and an end-point pitch value selected from said plurality of pitch values and each segment candidate has a start segment point and an end segment point, the start segment point aligned with the sampling point of the start-point pitch value and the end segment point aligned with the sampling point of the end-point pitch value, and wherein the plurality of consecutive simplified contour segments are selected among said segment candidates based on pre-selected criteria and on deviation between each of the segment candidate and said pitch values in the corresponding sub-segment, and wherein each of the simplified segments is defined by a first end point having a first pitch value and a second end point having a second pitch value, and wherein the first pitch values of the first end points of at least some simplified segments are different from the start-point pitch values of the corresponding sub-segments and the second pitch values of the second end points of at least some simplified segments are different from the end-point pitch values of the corresponding sub-segments, and wherein the received audio data comprises the end points defining the sub-segments, wherein each of the simplified contour segments is selected from a corresponding group of segment candidates, and wherein the simplified contour segments comprise a first contour segment and a plurality of subsequent contour segments, and wherein, in generating the pitch contour segment candidates, the start-segment pitch value of the group of segment candidates corresponding to each of the subsequent contour segments is the same as the end-segment itch value of the simplified contour segment immediately preceding said each of the subsequent contour segments, and the start-segment pitch value of the group of segment candidates corresponding to the first contour segment is selected based on the start-segment pitch value of the sub-segment corresponding to first contour segment, and wherein the sub-segment corresponding to the first contour segment is representative of the pitch contour data first available after an inactive or unvoiced speech or at the beginning of an encoding process; and a reconstructing module configured to reconstruct the audio segment based on the received audio data.

22. An apparatus comprising:

means for receiving pitch contour data, the pitch contour data comprising a plurality of pitch values obtained from an audio segment of an audio signal at a plurality of sampling points at regular time intervals;

means, responsive to the pitch contour data obtained from said regular time intervals, for generating a plurality of pitch contour segment candidates, each segment candidate corresponding to a sub-segment of the audio signal, wherein each sub-segment has a start-point pitch value and an end-point pitch value selected from said plurality of pitch values and each segment candidate has a start-segment pitch value at a start segment point and an end-segment pitch value at an end segment point, the start segment point aligned with the sampling point of the start-point pitch value and the end segment point aligned with the sampling point of the end-point pitch value, means, for measuring deviation between each of the pitch contour segment candidates and said pitch values in the corresponding sub-segment, and means for selecting, among said segment candidates, a plurality of consecutive simplified contour segments to represent the audio segment based on the measured deviations and pre-selected criteria, wherein the start-segment pitch values of the start segment points of at least some selected segment candidates are different from the start-point pitch values of the corresponding sub-segments and the end-segment pitch values of the end segment points of at least some simplified contour segments are different from the end-point pitch values of the corresponding sub-segments, wherein each of the simplified contour segments is selected from a corresponding group of segment candidates, and wherein the simplified contour segments comprise a first contour segment and a plurality of subsequent contour segments, and wherein, in generating the plurality of pitch contour segment candidates, the start-segment pitch value of the group of segment candidates corresponding to each of the subsequent contour segments is the same as the end-segment pitch value of the simplified contour segment immediately preceding said each of the subsequent contour segments, and the start-segment pitch value of the group of segment candidates corresponding to the first contour segment is selected based on the start-segment pitch value of the sub-segment corresponding to first contour segment, and wherein the sub-segment corresponding to the first contour segment is representative of the pitch contour data first available after an inactive or unvoiced speech of at the beginning of an encoding process.

23. The apparatus according to claim 22, further comprising means, responsive to the simplified contour segment, for coding the sub-segment of the audio signal corresponding to the simplified contour segment with characteristics of the selected simplified segment.

* * * * *

UNITED STATES PATENT AND TRADEMARK OFFICE

CERTIFICATE OF CORRECTION

PATENT NO. : 8,380,496 B2
APPLICATION NO. : 12/150307
DATED : February 19, 2013
INVENTOR(S) : Rämö et al.

It is certified that error appears in the above-identified patent and that said Letters Patent is hereby corrected as shown below:

In the Claims

Column 19,
Line 20, "end-segment itch value" should read --end-segment pitch value--.

Signed and Sealed this
Twenty-seventh Day of August, 2013

Teresa Stanek Rea
*Acting Director of the United States Patent and Trademark Office*